US010235842B2

(12) United States Patent
Glassman

(10) Patent No.: US 10,235,842 B2
(45) Date of Patent: Mar. 19, 2019

(54) VALUE-VARIABLE GAME OF CHANCE

(71) Applicant: GLASSMAN PRODUCTIONS, INC., Los Angeles, CA (US)

(72) Inventor: Andrew Glassman, Los Angeles, CA (US)

(73) Assignee: GLASSMAN PRODUCTIONS, INC., Los Angeles, CA (US)

( * ) Notice: Subject to any disclaimer, the term of this patent is extended or adjusted under 35 U.S.C. 154(b) by 0 days.

(21) Appl. No.: 15/598,233

(22) Filed: May 17, 2017

(65) Prior Publication Data

US 2017/0333781 A1 Nov. 23, 2017

Related U.S. Application Data

(60) Provisional application No. 62/337,735, filed on May 17, 2016.

(51) Int. Cl.

| | |
|---|---|
| ***A63F 7/40*** | (2006.01) |
| ***G07F 17/32*** | (2006.01) |
| ***A63F 7/00*** | (2006.01) |
| ***A63F 7/02*** | (2006.01) |
| ***A63F 7/04*** | (2006.01) |
| ***A63F 7/30*** | (2006.01) |

(Continued)

(52) U.S. Cl.

CPC ..... *G07F 17/3288* (2013.01); *A63F 7/0088* (2013.01); *A63F 7/022* (2013.01); *A63F 7/045* (2013.01); *A63F 7/048* (2013.01); *A63F 7/3075* (2013.01); *A63F 7/40* (2013.01); *A63F 2007/4075* (2013.01); *A63F 2009/0087* (2013.01); *A63F 2009/2454* (2013.01); *A63F 2009/2482* (2013.01)

(58) Field of Classification Search

CPC ..... A63F 7/0005

See application file for complete search history.

(56) References Cited

U.S. PATENT DOCUMENTS 2,563,019 A * 8/1951 Gelb ..... A63H 33/005 446/461

4,142,715 A * 3/1979 Matsumoto ..... A63F 7/04 273/337

(Continued)

OTHER PUBLICATIONS

"Pachinko", https://en.wikipedia.org/wiki/Pachinko, Wikipedia, last edited Sep. 3, 2017.

(Continued)

*Primary Examiner* — Michael Dennis

(74) *Attorney, Agent, or Firm* — Foley & Lardner LLP

(57) ABSTRACT

A method for playing a value-variable game of chance includes providing a random number generator including one or more walls forming a grid, the grid including an entrance zone and a finishing zone, and the grid being configured to support a transit of a puck from the entrance zone to the finishing zone; providing the finishing zone as including two or more finishing positions, each of the finishing positions configured to receive the puck, and each of the finishing positions being assigned a different finishing position value; providing the grid as including one or more deflectors; introducing a puck into the grid at the entrance zone and subjecting the puck to a force to drive the puck to the finishing zone, and allowing the puck to be deflected off any of the deflectors that it impacts during the puck's transit.

17 Claims, 3 Drawing Sheets

(51) Int. Cl.
*A63F 9/00* (2006.01)
*A63F 9/24* (2006.01)

(56) References Cited

U.S. PATENT DOCUMENTS

| | | | | | |
|---|---|---|---|---|---|
| 5,016,879 | A * | 5/1991 | Parker | A63F 7/022 | 273/121 B |
| 5,301,942 | A * | 4/1994 | Lacrosse | A63F 7/02 | 273/138.3 |
| 6,419,225 | B2 * | 7/2002 | Sines | A63F 7/022 | 273/120 A |
| 6,656,040 | B1 * | 12/2003 | Brosnan | G07F 17/3262 | 273/121 B |
| 6,669,195 | B1 * | 12/2003 | Gordon | A63F 7/022 | 273/121 B |
| 2007/0235932 | A1 * | 10/2007 | Karwat Singer | A63F 9/183 | 273/256 |
| 2010/0171265 | A1 * | 7/2010 | Paul | A63F 3/00006 | 273/243 |
| 2016/0129341 | A1 * | 5/2016 | Sahl | A63F 9/0406 | 273/142 E |

OTHER PUBLICATIONS

"Pinball", https://en.wikipedia.org/wiki/Pinball, Wikipedia, last edited Sep. 27, 2017.
"Plinko", http://priceisright.wikia.com/wiki/Plinko, Fandom, (Premiere Date: Jan. 3, 1983).

* cited by examiner

VALUE-VARIABLE GAME OF CHANCE

CROSS-REFERENCES TO RELATED APPLICATIONS

This application claims the benefit of priority to U.S. Provisional Patent Application No. 62/337,735 filed on May 17, 2016, hereby incorporated by reference in its entirety.

BACKGROUND

A popular form of gameplay that has taken on many different iterations involves dropping a ball through a maze of objects and seeing where the ball lands by random chance. Independently, people also enjoy games that involve trivia and demonstrations of skill. Disclosed herein are methods and devices for playing a new kind of game that merges elements of both of these forms of gameplay.

SUMMARY

According to various embodiments, there is provided a method for playing a value-variable game of chance. The method includes providing a random number generator including one or more walls forming a grid, the grid including an entrance zone and a finishing zone, and the grid being configured to support a transit of a puck from the entrance zone to the finishing zone; providing the finishing zone as including two or more finishing positions, each of the finishing positions configured to receive the puck, and each of the finishing positions being assigned a different finishing position value; providing the grid as including one or more deflectors configured to deflect the puck upon an impact of the puck with a given one of the deflectors; introducing a puck into the grid at the entrance zone and subjecting the puck to a force to drive the puck to the finishing zone, and allowing the puck to be deflected off any of the deflectors that it impacts during the puck's transit; receiving a player input at a time prior to the arrival of the puck at the finishing zone; using a combination of the player input and a puck finishing position value of a puck finishing position where the puck concludes its transit to set a player value; and assigning a winner to the game based on the player value.

DETAILED DESCRIPTION

Figure 1:
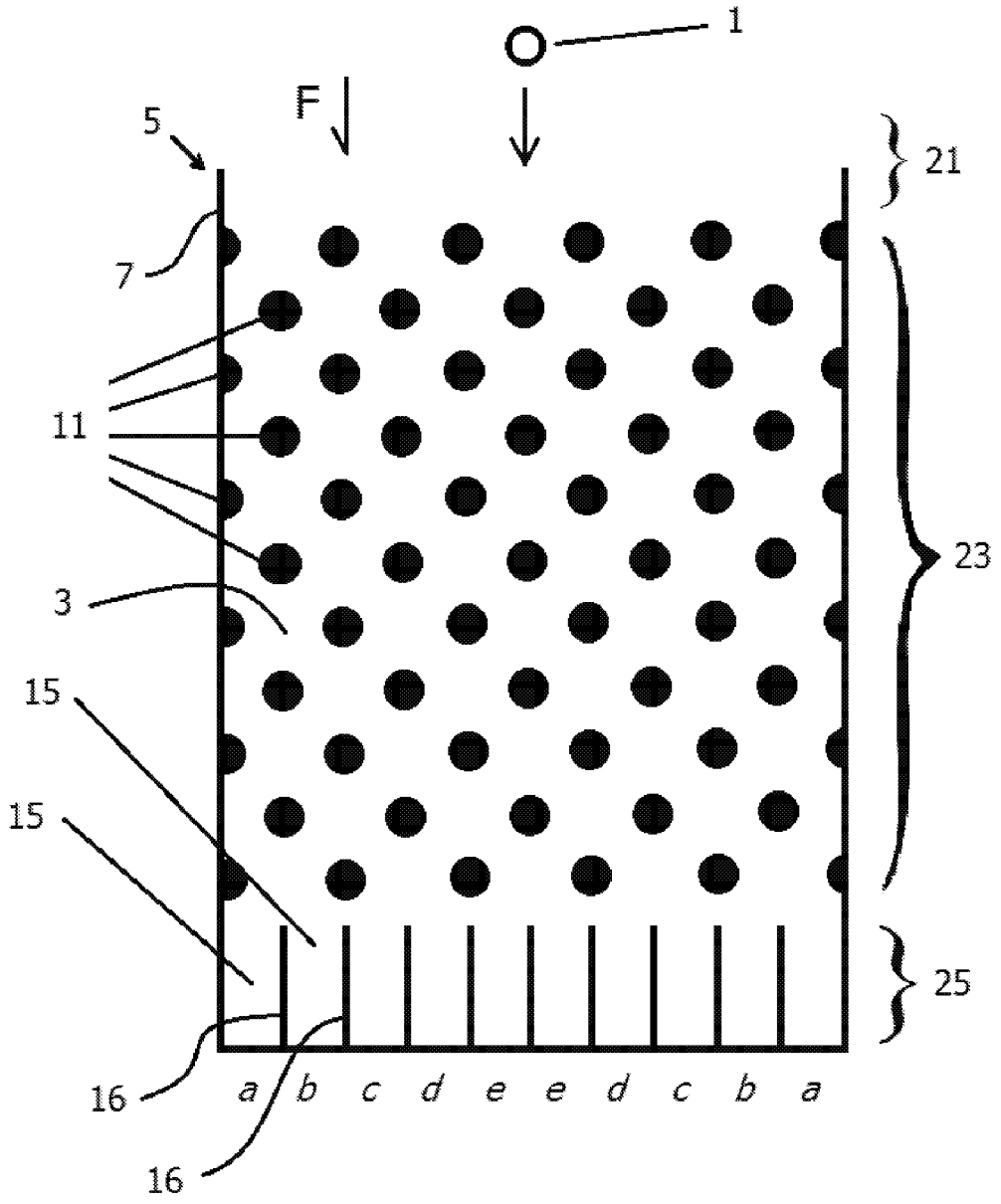
FIG. 1 depicts a two-dimensional grid according to some embodiments.

Before turning to the figures which illustrate example embodiments, it should be understood that the application is not limited to the details or methodology set forth in the following description or illustrated in the figures. It should also be understood that the phraseology and terminology employed herein is for the purpose of description only and should not be regarded as limiting.

Disclosed herein are devices and methods for constructing and playing a value-variable game of chance in which, while a random number generator is set into action, one or more players are prompted to provide inputs which will determine whether the ultimately-generated number will be added to or subtracted from their points total. The game can progress through several rounds of play, and the winner selected based on his or her final points total. The game has two principal aspects: (1) the random number generator, and (2) the player input.

Random Number Generator Grid

There are many comparable random number generators in various fields of gameplay, the simplest perhaps being a die. As used herein, "random number generator" should be understood to also encompass pseudo-random number generators. In some embodiments, the random number generator includes a physical grid through which an object (referred to herein as the "puck") is forced to pass, the puck being deflected by one or more obstacles ("deflectors") it encounters in the grid until it ultimately comes to rest at an end location ("finishing position") signifying a certain value. In some embodiments, the puck is forced through the grid under gravity, encountering and bouncing off of deflectors as it drops. Other forces aside from or in addition to gravity may be employed to compel the movement of the puck, such as fluid currents or magnetic attraction. The transit time for the puck through the grid will be referred to herein as the "drop time" regardless of whether the puck is literally dropped under the force of gravity or not. A basic characteristic of the grid is that it will have an entrance zone for the puck, a gameplay zone where the puck is within the grid and encountering the deflectors, and a finishing zone having a series of finishing positions, with the puck ultimately coming to rest at one of those finishing positions.

The grid may include a two-dimensional field, or a three-dimensional arrangement of deflectors, or a combination of both. The grid includes one or more walls designed to confine the puck to the grid. In a two-dimensional arrangement, the grid may include a wall forming a plane, and the deflectors may include a collection of projections attached to and rising up from the surface of the plane. Such projections could take the form of simple cylindrical posts rising from the plane, or could be made to have more elaborate contours, analogous to a mountainous landscape, optionally with ramps, shoots and/or slides. In some example two-dimensional embodiments, the grid can be made to generally mimic the construction of a pachinko device, i.e., a plane with a series of equally-spaced struts (deflectors) through which a ball (puck) is dropped under gravity, ending up at one of several finishing positions at the opposite side of the grid representing different point values.

The deflectors might also be made to move about the surface of the grid, adding an extra element of dynamic movement to the gameplay. The grid can also be made to take on the appearance of a real or fictional environment—such as a forest or the surface of another planet—with stereotypical objects from such environments serving as deflectors (e.g., trees, craters, etc.). Further walls extending from the boundaries of the plane can be employed to define a boundary beyond which the puck cannot pass. In other embodiments, multiple walls may define a fully enclosed grid space—a grid container—from which the puck cannot leave.

Movement of deflectors within the grid can be accomplished by several means. In some embodiments, the deflectors may lie on tracks, and be connected to a movement arm outside the grid that moves them along the tracks. Alternatively, the deflectors may be magnetized such that movement of a corresponding magnet outside the grid will cause the deflector to move within the grid. In certain embodiments, the external magnet moves on a track outside the grid, or is controlled by a mechanical arm outside the grid. Deflectors may also be made to be self-propelled, as will be further described below.

In some embodiments of the two-dimensional grid, the puck is kept substantially in contact with the surface of the grid during gameplay—or at least guided by the surface of the grid if not always strictly in contact with it—with the finishing positions also lying on the surface of the grid. This can be accomplished by laying the grid parallel with the ground or at an angle such that gravity will tend to hold the puck substantially to the surface of the grid as the puck moves. Maintaining the puck substantially in contact with the surface of the grid can also be accomplished by placing a transparent screen over the grid to constrain the puck to the grid's surface (which would allow the grid to stand upright, for example, as the puck falls through it). In some embodiments, the grid is designed such that game players and/or observers can see the puck travel through it, though covered areas may be included where the puck is temporarily out of sight to enhance the suspense of the gameplay, leaving players and observers to wonder at which location the puck will emerge.

In some three-dimensional embodiments of a grid, the puck may end up at any of several finishing positions not necessarily lying on the same plane. The three-dimensional grid may include a network of cylindrical posts spanning an enclosed structure, allowing the puck to be deflected in any of a variety of directions in three-dimensional space, yet constrained by the boundary walls of the grid such that it does not leave the space of the grid. The three-dimensional grid might also take on a more complex form representing real or fictional locales, such as a cut-away of a multi-story dwelling, or a jungle or underwater scene, with the deflectors taking the form of stereotypical structures or objects found in such environments. Deflectors can also be made to move within the grid. For example, in an aquatic-themed grid, deflectors may include models of sea life that "swim" through the grid, deflecting the puck upon impact. Tunnels may be added to allow the puck to travel in unique directions within the grid, or to cycle through all or part of the grid more than once. As with some two-dimensional embodiments, in some embodiments the puck is visible to the gameplayers during most of the gameplay, with covered portions optionally employed over certain areas of the grid for the sake of increasing a sense of suspense about the ultimate pathway of the puck.

Any or all of the grid walls may be constructed of a transparent material—such as clear polymer or glass—to aid the gameplayers in seeing the puck. In certain embodiments, a primary wall may be designated for the purpose of mounting the deflectors and other machinery necessary to operate the grid, and this primary wall need not be made transparent (though it can be). A viewing wall can then be mounted opposite the primary wall, connected to the primary wall either by side walls or mounting struts. The viewing wall can be made of transparent material and serve the function of helping to confine the puck to the grid while simultaneously allowing viewing of the puck as it transits through the grid.

In some embodiments, the three-dimensional grid may be filled fully or partially with a clear liquid, whether water, oil or otherwise. Though clear, the liquid may also optionally be colored. Furthermore, liquids of different viscosities can be used to create different viscous layers or effects within the grid. The use of liquid can have the effect of causing the puck to move more slowly through the grid than it would if the grid were merely filled with air. A liquid medium grid also introduces other unique possibilities, including (a) suspended, floating or self-propelled deflectors (such as by propeller or jet), (b) static or variable currents that deflect the puck through the grid, (c) a floating puck that starts at a low elevation point in the grid and rises toward a higher elevation portion of the grid (i.e., the reverse of the pathway the puck would take under gravity if the medium were air), and (d) liquid currents that force the puck through the grid, and keep it moving generally in a given direction even after the puck strikes a deflector. It will be appreciated that in order to achieve filling a grid container with liquid or pressurized gas, the grid container wall would need to be sealed so that it would not leak. A grid container with fluid might not need a top wall "lid" to the extent that the fluid would otherwise remain in the container under gravity, but in the case of a grid container filled with pressurized air, it will be advantageous to seal the entire container and construct the entrance zone in such a way that the introduction of the puck does not depressurize the container. This can be achieved, for example, by pressurizing the container after the puck is introduced through the entrance area, or by having the puck pass through a pressure lock containment area where the gas around it is pressurized before the containment area is opened to allow the puck to enter the grid.

A grid could also be constructed such that the entrance zone for the puck is a hole in the middle or center of the grid, with the gameplay zone surrounding it in all directions, and the finishing zone including the outer perimeter of the grid. Here, various forces such as air or liquid currents, moving deflectors, and the like can be employed to ultimately drive the puck towards a finishing position along the perimeter wall of the grid. A grid of this kind could also be placed on a mechanical tilt-table that moves during gameplay to allow the puck to fall in different direction under gravity. Alternatively, the grid could have a conical shape, with the puck being introduced through a hole at the apex of the cone, and then sliding down the slope of the cone in any of several directions at random based on the forces applied to the puck upon its passage through the entrance zone. For example, the puck can be propelled by an air jet through the entrance zone hole so that it "erupts" from the center of the conical grid, and then falls back onto the cone at a random location before transiting through that portion of the grid under gravity towards a finishing zone at a lower elevation around the perimeter of the grid. Thus, during gameplay, the puck starts at the center of the grid, and then may take a circuitous route in multiple different directions before reaching the finishing zone at the perimeter. In some inverse cone embodiments, akin to a roulette table, the entrance zone may include the entire outer perimeter of grid, with deflectors filling the gameplay zone along a downward-slanted surface wall of the cone, leading towards a finishing zone at the lowest elevation at the center, with multiple finishing positions arranged around the center. As in a roulette game, the puck may be propelled at random into the grid, ultimately entering at an unpredictable location before passing through the deflectors to reach a certain finishing position.

A grid may also be designed to allow the puck to drop under gravity through air that is blown upwards against the force of gravity, causing the puck to drop more slowly than it would in standing air. Motorized air blowers may be placed at the finishing zone for this purpose. In other embodiments, the grid may be enclosed on all sides by walls, and blowers placed in sequence along the side walls blowing upward and inward through openings in the side walls. In a design where the puck is made to experience forced air resistance, the puck may be configured to have flaps, wings, or other structures that tend to catch the air and increase the levitational effect of the upwards air current. If equipped with its own on-board motor, air jets or propeller propulsion, the puck can be made to fly through the air currents under its own power. As later discussed, this can be either controlled flight, or simply propulsion that keeps it moving through the grid. The deflectors too, can be designed to float or fly through the grid. The puck may be structured so as to tend to have one end that always points downward in the air current, allowing a point-of-view camera to be placed at the leading edge. A favored leading edge can be created by designing one end of the puck to catch the current, while making the other end more aerodynamic. Off-weighting of one end can also be employed, adding additional material to one end of the puck to make that end notably heavier than the other.

FIG. 1 depicts a simplified version of a two-dimensional grid, according to some embodiments. Here, a spherical puck 1 is shown poised at the entrance zone 21 to make a transit through the gameplay zone 23 of grid 5 under force F that tends to direct puck 1 towards the finishing zone 25. Grid 5 has a primary wall 3 mounting a series of cylindrical deflectors 11 rising from the primary wall 3. Finishing zone 25 contains finishing positions 15*a*, 15*b*, etc. that have been assigned finishing position values a, b, c, etc. Deflectors 11 in gameplay zone 23 serve to randomize the drop path of the puck 1 through the grid 5, causing it to be deflected randomly on its drop towards the finishing positions 15 until the puck comes to rest within one of the finishing positions 15. Separator walls 16 segregate one finishing zone from the next.

A three-dimensional pachinko-like grid can be constructed by creating a transparent walled container, for example cylindrical (though it may assume any shape), and creating a grid of struts (deflectors) spanning the sides of the container. The struts may be made of transparent material to aid in seeing the puck during the drop. As used herein, transparent materials may include transparent polymers, glass of suitable rigidity, or the like. In this three-dimensional pachinko-like structure, according to some embodiments, the struts are arranged in alternating parallel layers of struts, with the struts in each layer evenly spaced a distance X from one another.

Figure 2:
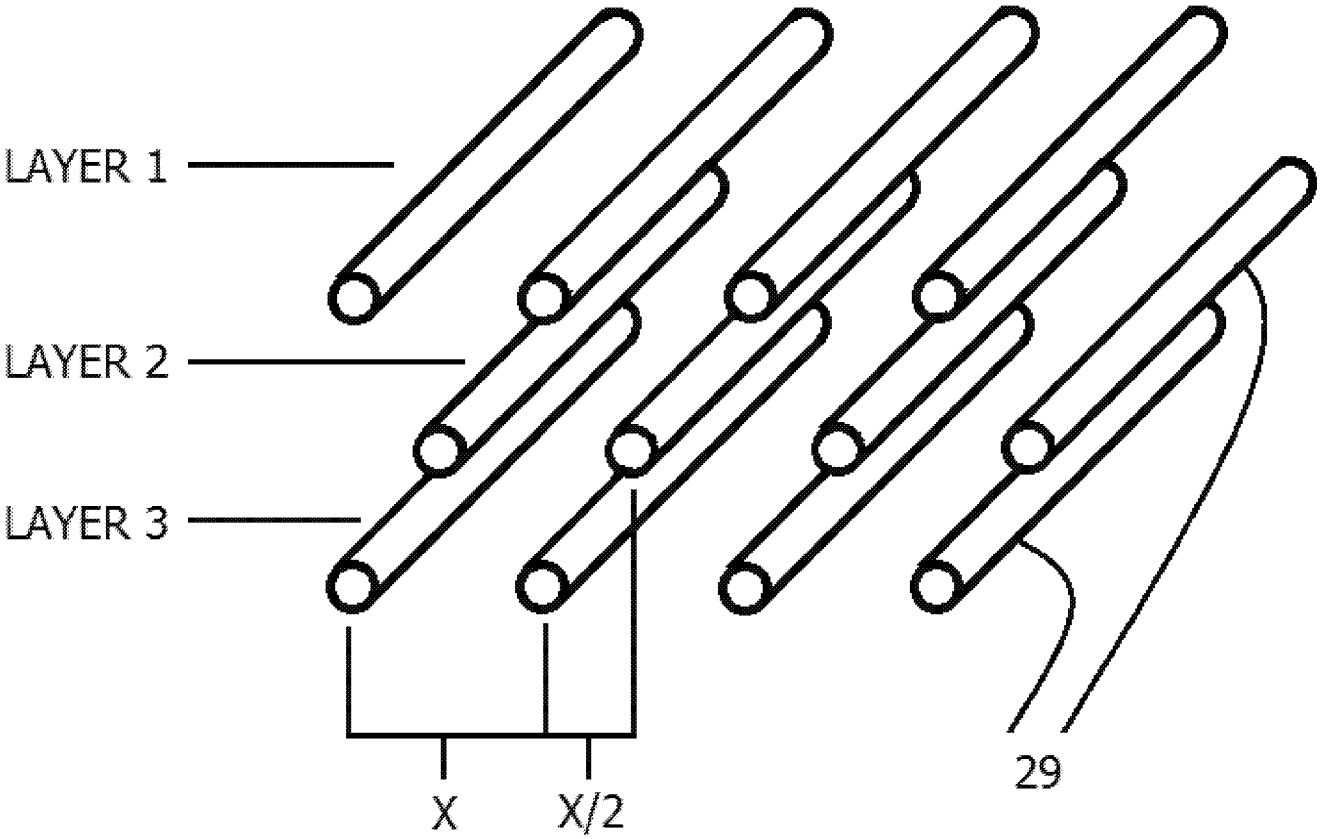
FIG. 2 illustrates a three-dimensional pachinko-like structure according to some embodiments.

FIG. 2 helps to illustrate the three-dimensional pachinko-like structure, according to some embodiments. Here, a first layer has struts 29 crossing a grid container from one side wall to the other (the grid container and side walls are not shown in the Figure). Additional layers can be arranged above and/or below the first layer. In FIG. 2, these are depicted as Layers 2 and 3 of additional struts 29. Although Layers 2 and 3 are shown here as having struts 29 arranged parallel with the struts of Layer 1, the struts need not be arranged so, and different layers can be made to have struts aligned perpendicularly or otherwise with respect to adjacent layers. In some embodiments (e.g., shown in FIG. 2), the layers are also shown to be off-set relative to one another such that, for any two given layers having struts oriented parallel to one another, one layer of struts is off-set a distance X/2 relative the other, such that if one looked down the axis of the grid container, those two layers would form a network of struts spaced a distance X/2 apart from one another. The grid container can contain numerous layers of struts, more layers equating to longer gameplay.

Intricacies can be introduced to the grid systems just described by constructing the struts to have wavy or bent shapes, or by causing one layer of struts to move or twist dynamically relative to another. Struts may also be inserted into and out of the grid entirely, or the degree of their projection into the grid modified (though not in such a way as to create a zone where a puck could get stuck). To enable such dynamic control over the movement of the deflectors that are connected to a grid wall (be they struts or any other object) it will be advantageous to have mounts for controls on the external side of the wall from where the deflectors are located. These mounts can support mechanical arms or other controls for moving the deflectors on the opposing interior side of the grid wall. If it is necessary to maintain a seal between the grid wall and the outside of the grid (such as, for example, if the grid is filled with liquid or pressurized air), sealed slip rings can be employed to maintain a seal, or alternatively, the connection between the external control arm and a given deflector inside the grid can be interrupted by a sealed elastic membrane, such as latex or other rubberized material. If the deflectors are constructed so as to have magnets, their movement can be controlled by corresponding magnets moved by a control arm, or on a track, on the outside of the grid wall. In the case of three-dimensional grid container, according to some embodiments, it may be advantageous to place the deflector mounts and controls on one side of the grid container walls, leaving the view to and through the remainder of the walls unobstructed.

A previously discussed, the grids can take on much more complex forms, and even themed forms. As yet further examples of this, a two-dimensional grid can be constructed to appear like a ski slope, with deflectors taking the form of contours on the slope, as well as trees projecting from its surface. A three-dimensional grid can be made to have the appearance of the cross-section of a ship, with layers taking the form of different levels of the ship, openings in the "floors" of each layer allowing passage of the puck, and objects made to look like piping and ship equipment acting as deflectors. A three-dimension grid could also be made to have the appearance of a star field in outer space, with the deflectors taking the form of asteroids or space ships. These non-limiting examples are intended to show the great variety of appearances and themes that can be adopted for a grid.

The deflectors need not be physical structures, but can also take the form of invisible forces acting on the puck. For example, air currents can be deployed within the grid in localized areas of varying intensity, or, if the puck is magnetic, magnetic zones can be created to alter the path of the puck. Physical deflectors could also be magnetized to accomplish similar objectives. Where otherwise invisible forces are employed to deflect the puck, they can be made "visible" to players and observers by having a light display or projection signify the force acting on the puck.

The design of the puck itself can affect gameplay. In some embodiments, the puck has the shape of a ball because a ball can roll and deflect, and has no edges that can become stuck on a deflector. However, other embodiments may use suitable shapes that are determined by testing or otherwise to not be susceptible to being stuck among the deflectors during gameplay. Indeed, the puck may be constructed to have a themed appearance consistent with any theme that may be employed for the grid (e.g., a spaceship in a star field).

In some two-dimensional grid embodiments in which the puck may slide across the surface of the grid, to aid in reducing friction, the grid can be made to have a network of tiny holes expelling air, as is commonly used on "air hockey" tables to allow a flat cylindrical air hockey puck to glide across a flat surface. In some air jet embodiments, an air pressure source is located outside the gameplay zone—either mounted to the exterior of the grid or near the grid—with air conducted to the holes via tubing or other sealed transfer compartment between the pressure source and the holes. In some air jet embodiments, the puck is constructed so as to have a broad surface facing the grid so as to take advantage of the air jets. If the puck is constructed of a magnetic material, it can also be made to levitate over the surface of the grid if the grid is magnetized in a manner to allow such low-friction levitation.

In certain embodiments, the puck's friction with the grid is increased for the purpose of slowing it down and increasing the gameplay time. This can be accomplished by constructing the surface of the grid with a high friction material such as rubber, or similar material. The friction of the grid surface may also be dynamically modified during the puck drop to increase and decrease the puck speed during the drop. This may be accomplished, for example, by turning surface air jets on or off, or by having perforations in the grid surface through which high-friction rubber bumps may be pushed upward so as to create a higher-friction dimpled surface within the grid, or retracted through the perforations to remove that added friction. The slowing of the puck will be referred to herein as "drag."

To allow the puck to be more easily visible to game players, in some embodiments the puck is made to have a color that contrasts with the rest of the grid environment, or an internal light source that allows it to glow clearly. The puck, if large enough, can also be made to have cameras so that players and observers can watch a live video of the puck's journey through the grid from the puck's perspective. Where such video technology is used, the puck may be shaped such that it will have a dominant end with the camera that tends not to spin excessively so that the camera feed is at least somewhat steady and understandable (unless the puck moves slowly enough regardless that such concerns are mooted). This can be accomplished, for example, by off-weighting the end of the puck with the camera so that the heavier end tends to be the leading end during the drop, and/or by placing flaps or other drag-inducers on the trailing end that create air resistance and tend to keep that end behind the leading end. The grid and the deflectors, too, can be constructed so as to contain live video cameras, so that the journey of the puck through the grid can be watched by players or observers from multiple live perspectives.

In certain embodiments, the puck can be made to have its own propulsion system powered, for example, by an internal motor or battery. The propulsion will have the effect of propelling the puck through the grid and into deflectors. Such propulsion could be accomplished by wheels, propellers, or by air jets, for example, and could be used to either accelerate, decelerate, or further randomize the journey of the puck through the grid. As with some on-board camera embodiments, where the puck is caused to fall through the grid under gravity, it will be advantageous to off-weight the puck so that one end tends to fall first, allowing the puck to have a more defined orientation for acceleration or deceleration purposes. In some embodiments of the grid that is filled with fluid, the puck can be made to rise up through the grid if it is buoyant relative to the fluid, and by making one end of the puck more buoyant than the other, the puck's orientation can be roughly maintained. As used herein, "fluid" is intended to encompass both gaseous and liquid fluids. A puck can also be self-propelled through a liquid medium with a propeller, and on-board air jet, or an on-board liquid jet.

In certain embodiments, the propulsion system on the puck can be controlled via a remote control handset by a participant in the game such that the participant can attempt to steer the puck to whatever degree possible. To prevent the participant from having too much control over the final finishing position reached by the puck, the deflectors can be made to move and act on the puck in sufficiently frequent and unpredictable ways that the participant's sense of control over the final finishing position of the puck is partially or fully an illusion. However, the game can also be played in such a manner as to allow the participant greater control over the puck, in effect turning the grid and the deflectors into an obstacle course for a remote-controlled puck, with the player actually being able to achieve a desired finishing position (or at least have a greater chance of reaching that desired finishing position) through his or her skill in remotely controlling the movement of the puck. For example, a player could "drive" the puck through the grid while viewing a live video from the puck's perspective in the grid. In some embodiments, the grid should not be thought of as a random number generator, but rather as an obstacle course that can be navigated by skill, with deflectors adding an element of challenge (as well as randomness if the deflectors are made to have random or unpredictable movements).

Figure 3:
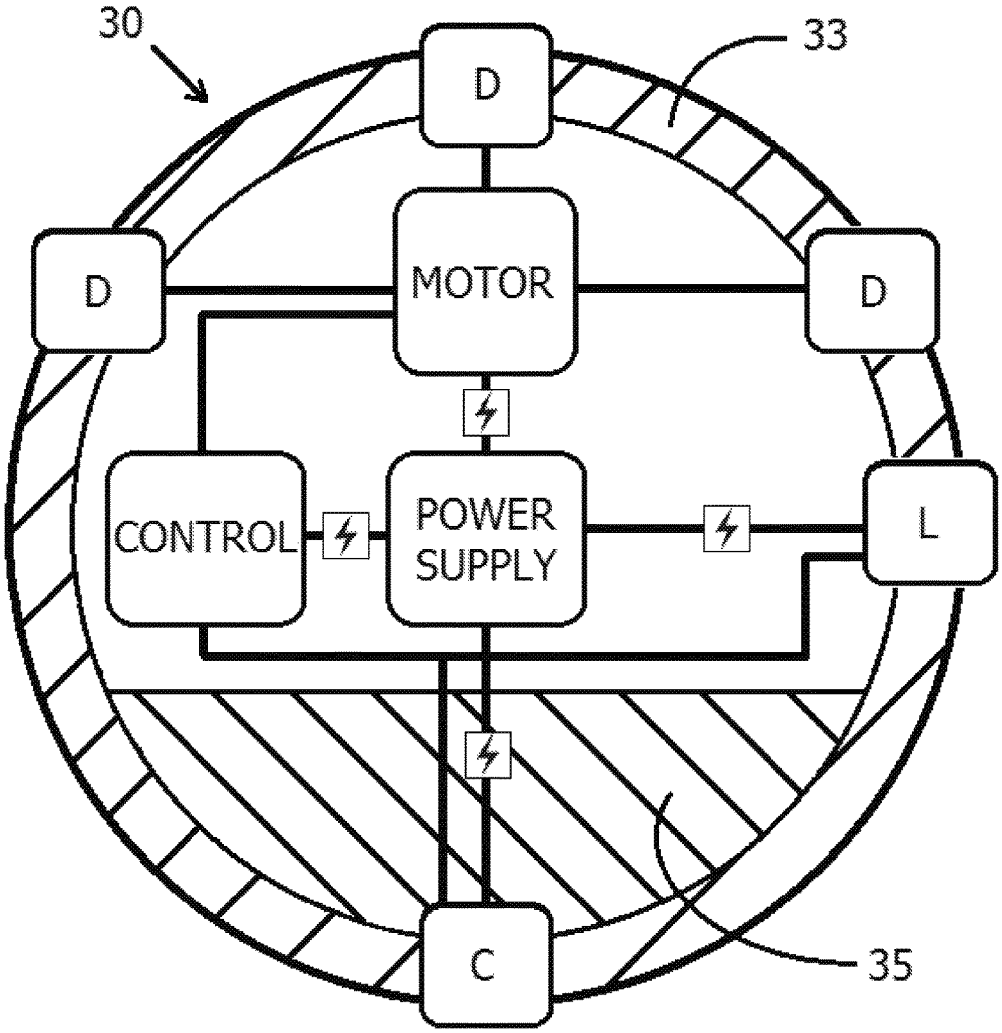
FIG. 3 illustrates a schematic example of a puck with on-board equipment according to some embodiments.

FIG. 3 is a schematic example of a puck with on-board equipment. The puck shown here is a hollow sphere 30 having a wall 33 and a weighted end 35 whose purpose is to help orient and stabilize the puck as described elsewhere herein. As shown, the puck has a power supply, such as a battery, for powering other components. One or more motors connected to the power supply can be made to drive one of more propulsion units, D. Such propulsion units D could be wheels, propellers, air jets, or the like. One or more light emitters L can also be mounted to the puck, either internally or in the walls 33. Where light emitters L are mounted internally, the puck wall should be at least partially transparent to allows the light to be seen. A video camera C is shown mounted in the walls 33 of the puck to allow point-of-view video from the puck. The unit labeled "Control" in FIG. 3 contains a microprocessor, and a receiver/transmitter. The microprocessor controls the operation of the camera C, the Motor and the light emitters L. The receiver/transmitter allows wireless signals to be received and transmitted by the Control unit, such as outbound video signals or inbound commands for operation of the Motor to drive the propulsion units. It should be noted that the schematic shown in FIG. 3 could also apply to a deflector as well as puck, wherein the deflector can be enabled to have all the same functions just described. The term "deflector/puck" will be used herein as a generic reference to a device that could act as either a deflector or a puck.

The overall size of the grid and the gameplay zone is largely dictated by how long it is desired that the gameplay last. This is in turn related to the nature of the player inputs (discussed below), and how long those inputs take to enter. The design of a grid and its deflectors may be tested to determine the average drop times of the puck from the entrance zone to the finishing positions, and the grid modified accordingly to achieve the desired drop time. A grid may also be constructed of multiple sub-grids, which may have differing designs and support different drop times for the puck. By connecting multiple grids together, a longer drop time is achieved. Likewise, by removing one or more grid sub-parts, the puck drop time can be decreased. Separate grids can be joined and detached by any suitable detachable connection means on their walls, such as tongue-and-groove connectors, latches, bolts, or the like.

The finishing positions may take the form of either a physical structure or a force field (e.g., magnetic field) that will firmly entrap the puck, taking into consideration the maximum speed and elasticity of the puck upon arrival at the finishing position. In some embodiments, the finishing positions can be containers or wells in the grid wall having a depth that the puck cannot escape from, even at maximum rebound velocity. The finishing positions could also be designed as holes in the grid wall through which the puck is simply removed from the grid. A finishing position might also constitute a position with a sensor that registers the passage of the puck over the sensor. The puck's arrival at any of the foregoing examples of finishing positions can be referred to as the finishing position "receiving" the puck.

It is not necessary that the finishing positions be arranged adjacent to or even near one another. For example, one finishing position may be located in a first position within the grid, while a second finishing position may be located further along the grid such that more gameplay would elapse before the puck could reach it. In some embodiments, however, the finishing positions are arranged such that the puck will tend to come to rest at any given finishing position after a substantially similar amount of gameplay.

There are at least two finishing positions associated with two different finishing position values, or else there is no significance to the random chance of the deflection of the puck through the grid to end up at one or another different finishing position. In particular embodiments, there are numerous finishing positions having a variety of different associated values to make the gameplay more complex and interesting. In some embodiments, the grid is designed such that the puck has no alternative but to come to final rest at one of the finishing positions. Thus, each possible path of the puck through the grid may result in the puck coming to rest at a single finishing position. Alternatively, a gutter may be employed to capture pucks that have missed all of the finishing positions, and perhaps some point value—positive or negative—assigned to the gutter. A puck that reaches the gutter might also be recycled through the grid until it does come to rest at a finishing position. Such recycling can be accomplished, for example, by directing the puck along motorized tracks that carry the puck to another location in the grid.

The value at the finishing position can be a number, but variants of the game are possible in which the value corresponds to some other thing which has meaning within the theme of the game. For example, if the game has an aquatic theme, the finishing positions may have depictions of certain different sea life which are assigned some relative value or meaning with respect to one another within the rules of the game.

An important aspect of the grid design is to ensure the grid, the deflectors, and the finishing positions are designed and arranged to support the desired degree of randomness of finishing positions attained by the puck on successive drops through the grid. An infinite variety of grid designs are possible, and the simplest way to design for randomness for any given grid will be to conduct successive tests, plotting the drop path of the puck on each test and which finishing position it arrives at. After a statistically significant number of tests, the builder will have a good understanding of the likelihood of the puck reaching any given finishing position, and can also modify the construction of the grid, the deflectors and the finishing positions to achieve a different degree of randomization.

Likewise, successive testing can be used to determine the optimal design of the grid and deflectors to ensure a given probability of the drop time have a certain desired consistent length. For example, the grid and deflectors can be modified until successive testing confirms that their configuration will ensure a 75% probability that the drop time will be with 10% of a certain predetermined target value. Greater (or lesser) degrees of certainty are possible by varying the construction of the grid and the positions of the deflectors. For example, grids may be constructed so as to have highly predictable drop times, where there is a 90% certainty that the drop time will be with 10% of a certain predetermined target value. Minimizing the number of deflectors and/or increasing the spacing between the deflectors will generally have the effect of increasing the certainty of the length of the drop times. Making the grid simpler and smoother, with fewer surface variations and contours, also will generally have the effect of increasing the certainty of the length of the drop times. The grid and deflectors can also be modified until successive testing confirms that their configuration will ensure certain probability that the drop time will be less than a certain target amount of time. For example, the grid and deflectors can be modified until successive testing confirms that their configuration will ensure a 75% chance of drop times less than 10 seconds.

For purposes of points allocation in gameplay, the points values of the finishing positions should be assigned in accordance with the desired points outcome(s) of the game. For example, in one form of gameplay, the object will be to score the highest number of points. Thus, the lowest value finishing positions should be the most likely to be hit by the puck, and the highest value finishing positions should be the least likely to be hit by the puck. If the probability distribution in the finishing zone is that of a bell curve, then the highest value finishing positions should be places at the peripheries of the finishing zone, with the lowest value finishing positions in the center of the finishing zone. In certain forms of competitive gameplay, such as for example in a gameshow or casino context, the points can be made to correspond to a dollar prize payout.

The entrance zone can also be configured so as to have different entrance positions for the puck, which each entrance position providing a greater or lesser probability of the puck ending at a certain finishing position. For example, in an embodiment in which the highest value finishing position is on one side of the grid, the grid and deflectors can be constructed and tested through repetitive testing such that it is known that starting the puck at an entrance position near that same side of the grid will increase the chances of the puck reaching that highest value finishing position.

Player Inputs

In some embodiments, gameplay consists of successive rounds in which a puck is dropped through the grid, and the points values of the finishing positions reached by the puck after each round are added to reach a final tally. Points values secured by players may also be referred to herein as "player values." The game may be played by a single participant, or a team of participants, and that single participant or team can (a) compete against one or more other single participants and/or teams by accumulating a higher final points tally, or (b) try to achieve a final points tally that is above a pre-designated qualifying threshold. In an electronic version of the game, a computer may simulate an opponent of a human player.

In some embodiments, the player(s) has the ability to provide an input that will determine whether the value of the finishing position reached by the puck will be added or subtracted to that player's (or his or her team's) total score tally. Thus, for example, if a high value finishing position is reached, this will either significantly help, or significantly undermine, the player's running points tally depending on whether the player's input resulted in that finishing position value being assigned a positive or negative value. Likewise, a low value finishing position will have less effect on the player's running points tally either way.

As previously discussed, the finishing positions need not strictly represent "points" in the sense of numbers. For example, in a manner similar to the commonly known "rocks-paper-scissors" game, the finishing positions may correspond to certain objects or things which have some relative "value" with respect to one another, and "winning" the round may be based on which object or thing is obtained. Similarly, the player inputs may have the effect of causing the object or thing at the finishing position to have either favorable or unfavorable qualities. In an example of this gameplay, or player (or team) is pitted against a second player (or team), and each round consists of a separate puck drop by each player, with the results compared to determine the winner. A tally is kept of how many rounds each player wins, and the winner determined by which player has won the most rounds. The player inputs can have the effect of determining whether the finishing position object will have a higher or lower probability of defeating the opposing player's finishing position object. For example, a certain finishing position object may be deemed to have either an 80% chance of defeating an opposing player's finishing position object, or only a 20% chance, depending on whether the player input is deemed positive or negative (such as a correct response or an incorrect response to a challenge, as discussed below).

In various embodiments of the game, the input can be provided before the puck is introduced to the grid, while the puck is transiting through the grid, or after the puck has already reached a finishing position. Alternatively, in lieu of inputs that cause finishing position values to switch from positive to negative, an input given before the puck reaches the finishing position can be made to have the effect of reassigning the values of the finishing positions to make it more or less likely that the puck will reach a higher value (given the known probability distribution of the puck landing at any given finishing position). It is also possible for more than one input to be provided, with certain combinations of inputs having the effect of altering what the final finishing position value will be.

In certain embodiments, the player inputs will be responses to some form of challenge, whether in the nature of a verbal response to a trivia question, or a physical challenge such as a test of marksmanship or stamina. Such challenges are commonly known on televised game shows and at-home trivia games. If the participant (or the participant's team) succeeds at the challenge, the participant will be rewarded by having a positive input entered into the gameplay. For example, if the participant answers a trivia question correctly, this can cause the finishing position value for that round of gameplay to be deemed to have a positive (rather than negative) value, whereas answering a trivia question incorrectly would have the effect of causing the finishing position value to be subtracted from the participant's total points tally. Likewise, if the challenge consists of a physical challenge, such as marksmanship, if the player strikes the mark, the input will be deemed positive, but if the player misses the mark, the input will be deemed negative. In certain other embodiments, the player input need not be based on a challenge. For example, in some embodiments, the game might be constructed as one game of chance inside another, whereby the player input is supplied by the player triggering a second game of chance, such as a slot machine, wherein the result obtained from that game of chance determines the input supplied in the primary game.

In other example embodiments, the challenge may consist of a novel form of "reverse multiple choice." Here, the player(s) is presented with a list of several answers to an unknown multiple choice question. In some instances, a correlation may be apparent among the answers (e.g., John, Paul, George, and Ringo), but in other instances, there may be no immediately apparent correlation (such as a series of numbers which, when the question is revealed, might turn out to correspond to different days of a month). Based on the multiple choice answers presented, the player(s) can make decisions about how confident they are that they will be able to answer the question ultimately asked. In certain embodiments, the player(s) may place a bet based on their level of confidence, choosing to, for example, double the potential points value of their input into the game. Such bets can be placed before the puck drop, and the question revealed at the start of the puck drop such that the player(s) must answer the question correctly before the puck reaches a finishing position. In the example provided, if the player(s) answers the multiple choice question correctly during the puck drop, the points value of the finishing position would be doubled in the positive direction, whereas if the player(s) fails to answer correctly, twice the points value of the finishing position would be deducted from their score.

The player inputs can have different degrees of a positive or negative impact. For example, if the player succeeds at a particularly difficult challenge (or performs better out of a range of possible outcomes, such as distance from a bullseye in a marksmanship challenge) the player input may have 2× positive effect, doubling the value of the finishing position. Likewise, a particularly poor showing on a challenge could give the input a 2× negative effect, subtracting twice the value of the finishing position from the player's total points tally. In the context of a trivia challenge, for example, the player may elect in advance to choose a trivia question of a certain difficulty level, with the result being that a correct answer will provide a 2× positive input, but an incorrect answer (or no answer) will provide a 2× negative input.

Various versions of the game may be devised in which the player input occurs either before, during or after the puck drop, depending on the desired degree of suspense and activity. In some embodiments, the player input is supplied during the puck drop to make the game more dynamic and suspenseful, and to have the effect of running a "timer" on the player by requesting an input before the puck reaches a finishing position. In this regard, it is apparent that it is advantageous to construct the grid so as to guarantee an approximate range of expected drop times, so that gameplay is generally consistent from one round to the next using the same grid. For example, in some embodiments, the grid can be constructed and tested so as to assure that there is at least a 75% probability that any given drop time will be within 10% of a pre-determined target drop time, or that there is a 75% probability that the drop time will be less than a predetermined amount of time, such as 10 seconds.

In some embodiments, a grid is constructed so as to have an average single puck drop time of approximately 10 seconds, and the challenge is explained to the player before the puck drop (or the trivia question asked before the puck drop), and then the player has until before the puck reaches a finishing position to respond successfully to the challenge. A failure to respond successfully will result in a negative input, and a successful response will result in a positive input. In some embodiments, a sensor is employed in the grid ahead of the finishing zone, and the time to respond to the challenge expires when the puck trips the sensor (which may cause an alarm to sound, a light display to commence, etc). In some embodiments, the sensor is a magnetic trigger or an optical beam whose interruption is detected by a computer.

The drop times for any given round could be augmented by adding or subtracting sections of the grid, or deflectors from within the grid. Similarly, mechanisms may be employed to keep the puck from reaching the finishing positions when it otherwise would, such as introducing a current (air or liquid) into the grid, dynamically inserting new deflectors into the grid in the path of the puck, or capturing the puck in a mechanism that recycles the puck through all or a portion of the grid. Such "puck-drop-delay" mechanisms may be used by players to allow more time to respond positively to the challenge on a given round. For example, at the start of gameplay, each player may be allotted a total of three puck-drop-delay credits that can be used at any point throughout the gameplay, but which are lost once used. In certain versions of the game, puck-drop-delay credits may be won by players who respond correctly to two challenges within a single round, or who succeed at some other relatively difficult challenge. Alternatively or additionally, players may be assigned (or may win) "puck-drop-acceleration" credits, which when used will cause an opponent's puck to drop more quickly, decreasing the time which the opponent has to respond to his or her challenge. Puck drop acceleration may be induced by removing deflectors, or by introducing currents (air or liquid) that tend to force the puck closer to the finishing positions. Puck-drop-delay and puck-drop-acceleration can be referred to collectively as "drop time modification mechanisms."

In other embodiments, multiple players can play simultaneously by having each of their pucks dropped into the grid such that the pucks "compete" for finishing positions, and if one puck obtains a highly favorable finishing position, it prevents the other puck(s) from reaching that same position. To make gameplay less confusing in this variant of the game, the players may respond to their challenges before the puck drops. That way, all players and observers already know if the player inputs are positive or negative before the puck drop begins, and the suspense is in watching the players' pucks navigate the grid simultaneously in "competition" for a finishing position. Alternatively, the puck drop could occur first, and the challenges second.

In other embodiments, a single player may be assigned multiple pucks that drop through the grid during overlapping time periods, and the finishing position values of the pucks may be added to arrive at a total player value for that round.

In other embodiments (referred to herein as "grid player embodiments"), players can participate simultaneously in the game by allowing one player to attempt to modify the path of the puck in the grid during the puck drop (the "grid player") while the other player responds to the challenge (the "challenge payer"). The grid player can be given controls to the grid with options for (a) having air or liquid currents (or magnetic fields) act on the puck, or (b) controlling movement of deflectors in the grid. The grid player can also be given remote control (via, for example, a remote control handset) of a self-propelled "chase puck" which can be steered by the grid player to try to intercept the drop puck in an effort to deflect the drop puck's course. The grid player can be a member of the challenge player's team ("ally grid player") who is seeking to have the puck land in a desired finishing position, or the grid player may be an opponent who is seeking to have the puck land in an unfavorable finishing position. Any ally grid player and an opponent grid player—or more than one of either—can play simultaneously, doing their best to modify the drop path of the drop puck to their own advantage. In some embodiments, the ability of the grid players to successfully guide the drop puck to a specific finishing position will be limited such that the final finishing position of the puck still remains subject to chance, with the grid players trying essentially to increase the odds of a particular finishing position.

In some grid player embodiments, the challenge is completed before the puck drop, or there is an extended grid course in which a trigger sensor is located part-way through the grid, such that when the puck passes the trigger sensor, the challenge period is over and the challenge player's input (positive or negative) is determined before the puck passes through the second half of the grid. The grid player(s) can either compete throughout the entire puck drop, or commence competition at the trigger sensor signal. By structuring the game this way, the grid player(s) will know by the time the drop puck hits the trigger sensor whether the challenge player's input was positive or negative, and the grid player can then try to guide the drop puck to land at the most favorable finishing position in light of the challenge player's input (for example, a low value finishing position if the input was negative, and a high value finishing position if the value was positive).

In some embodiments, the puck is designed to have an internal light source that will remotely change colors depending on whether the player input is positive or negative. For example, in a version of the game where the player responds to a challenge as the puck is dropping, if the player responds successfully to the challenge, the puck's on-board light may turn green, but if the player does not respond successfully, the puck's on-board light may turn red. This lighting scheme adds to the interactivity of the game, and easily allows both players and observers to see if the player input is positive or negative.

Computer Simulation

The grids described herein are not limited to physical devices, but also include computerized simulations of grids. The entire grid may be substituted for a computer simulation in which all of the odds and variables are programmed into the computer. Using a computer simulation, the grid, puck and deflectors can be made to take on essentially any shape or appearance. The computer program can also be made to simultaneously simulate a point-of-view camera from the perspective of the puck, or various positions within the grid.

Alternatively, a physical grid may be augmented using computer simulations and projections. For example, a translucent computerized overlay or light projection may be created over a physical grid to add digital effects, such as light and color, or the appearance that the grid is a certain kind of environment (for example, a forest of trees) through which the puck is travelling. Indeed, by using a computerized overlay or image projection, the same physical grid can be made to take on multiple appearances over the course of gameplay.

It should be further understood that, as used throughout this entire specification, "or" should be construed as inclusive or, such that, for example, "A or B" means A, B, or A and B, and for example, "A, B, or C" means A, B, C, or any combination thereof (e.g., A and B, A and C, B and C).

It should be further understood that, as used throughout this entire specification, "a" and "an" are not limited to a single instance and should be construed as "one or more," such that, for example, a database "storing information of a steward" is a database storing information of one or more stewards.

The foregoing description of example embodiments has been presented for purposes of illustration and description.

It is not intended to be exhaustive or to limit the disclosure to the precise form disclosed, and modifications and variations are possible in light of the above teachings or may be acquired from this disclosure. The embodiments were chosen and described to explain examples of the disclosure and its practical application to enable one skilled in the art to utilize various embodiments and with various modifications as may be suited to any particular use contemplated. Other substitutions, modifications, changes, and omissions may be made in the design, operating conditions, and arrangement of the embodiments without departing from the scope of the present disclosure as expressed in the appended claims.

What is claimed is:

1. A method for playing a value-variable game of chance, said method comprising:

providing a random number generator comprising one or more walls forming a grid, said grid including an entrance zone and a finishing zone, and said grid being configured to provide a transit for a puck from said entrance zone to said finishing zone;

providing said finishing zone as including two or more finishing positions, each of said finishing positions configured to receive said puck, and each of said finishing positions being assigned a different finishing position value;

providing said grid as comprising one or more deflectors configured to deflect said puck upon an impact of said puck with a given one of said deflectors;

introducing a puck into said grid at said entrance zone and driving said puck to said finishing zone, and allowing said puck to be deflected off any of said deflectors that it impacts during said puck's transit;

providing a propulsion unit on the puck to propel the puck during game play;

receiving a player input while said puck is in transit through said grid and at a time prior to the arrival of said puck at a given one of said finishing positions;

changing the finishing position value of the finishing position where the puck concludes its transit based on said player input to set a player value; and using said player value in determining the winner of said game.

2. The method of claim 1, wherein said method is repeated over a plurality of rounds, and said winner is determined based on the combination of player values achieved in said rounds.

3. The method of claim 1, wherein there are at least two players competing to achieve a highest player value.

4. The method of claim 3, wherein each player is assigned a different puck, and the method further comprises allowing said different pucks to transit through said grid during at least partially overlapping times.

5. The method of claim 1, wherein said player input is selected from the group consisting of (a) a player's degree of success in providing a correct answer to a question, and (b) said player's degree of success in completing a physical challenge performed outside of said grid.

6. The method of claim 1, the method further comprising configuring said grid to include a drop time modification mechanism, and using said mechanism to dynamically vary a drop time of said puck during said transit of said puck through said grid.

7. The method of claim 1, wherein said grid is a physical grid configured to be at least partially filled with liquid, and the method further comprises introducing said liquid to said grid prior to said transit of said puck such that said puck will be forced to travel through said liquid during at least a portion of said puck's transit.

8. The method of claim 7, further comprising providing at least one of said deflectors as a current of said liquid.

9. The method of claim 1, wherein said grid is a physical grid, and the method further comprises providing at least one of said deflectors as a current of fluid.

10. The method of claim 1, wherein said grid is a physical grid, and the method further comprises providing at least one of said deflectors as a magnetic field.

11. The method of claim 1, further comprising introducing a grid player capable of dynamically controlling said deflectors for at least part of a drop time of said puck.

12. The method of claim 1, further comprising introducing one or more additional pucks to said grid, each of whose drop time at least partially overlaps with the drop time of another of said pucks, and calculating said player value as being the sum of the finishing position values of all of said pucks.

13. The method of claim 1, further comprising providing more than one entrance position at said entrance zone, and configuring said grid and said deflectors such that selecting a given entrance position instead of another will increase the odds of said puck reaching a certain one of said finishing positions.

14. The method of claim 1, further comprising configuring said grid and said deflectors so as to ensure at least a 75% probability that any given puck drop time between said entrance zone and said finishing zone will be within 10% of a pre-determined target drop time.

15. The method of claim 1, further comprising configuring said grid and said deflectors so as to ensure at least a 75% probability that any given puck drop time between said entrance zone and said finishing zone will occur in less than ten seconds.

16. The method of claim 1, wherein the puck is a physical puck, and the method further comprises:

providing said puck with a light emitter and a receiver/transmitter, said receiver/transmitter configured to receive wireless signals; and transmitting a wireless signal to control said light emitter during game play.

17. The method of claim 1, wherein the puck is a physical puck, and the method further comprises:

activating said propulsion unit during at least a portion of game play to cause said puck to move during game play.

* * * * *